United States Patent [19]

Sweet

[11] 4,211,966

[45] Jul. 8, 1980

[54] LEVEL CONTROL SENSOR SWITCH MECHANISM

[75] Inventor: Donald B. Sweet, Carsonville, Mich.

[73] Assignee: Material Control, Inc., Aurora, Ill.

[21] Appl. No.: 973,825

[22] Filed: Dec. 27, 1978

[51] Int. Cl.[2] ..... H01H 35/00

[52] U.S. Cl. ..... 318/482; 200/61.21; 340/617

[58] Field of Search ..... 200/61.2, 61.21, 81.9 R; 340/615, 617; 318/482; 310/68 B, 68 E

[56] References Cited

U.S. PATENT DOCUMENTS

| | | | |
|---|---|---|---|
| 2,698,362 | 12/1954 | Bozich | 200/61.21 |
| 2,851,553 | 9/1958 | Grostick | 200/61.21 |
| 2,909,766 | 10/1959 | Bozich | 340/615 |
| 3,210,495 | 10/1965 | Law | 340/617 |

*Primary Examiner*—Gerald P. Tolin

*Attorney, Agent, or Firm*—Cullen, Sloman, Cantor, Grauer, Scott & Rutherford

[57] ABSTRACT

In a level control sensor switch mechanism mountable upon a bin containing bulk material of varying levels, a housing having a base which is mounted upon the bin wall and mounts a low-torque, low-speed electric motor having an output shaft which is coupled to a drive shaft journalled through the base, projects into the bin and mounts a paddle which is continuously rotatable when free of said bulk material, and is non-rotatable in said bulk material at a predetermined level thereof, stalling the motor. The improvement comprises an adjustment bracket upon the base mounting a torsion spring adapter. A stub on the motor axis is journalled within said adapter for limited rotary movement of the motor. A bracket secured to the motor projects from opposite sides thereof and is adapted for limited rotary movement with the motor in a plane at right angles to its axis. An adjustable time delay stop is mounted upon the adjustment bracket, retainingly engaging the motor bracket in a first position. The bracket has an extension arm at right angles thereto engageable by a torsion spring mounted upon the adapter. A second anchor is mounted upon the adjustment bracket for adjustably securing one end of the torsion spring. The other end of the spring biases said bracket and motor into its normal first position with the output shaft and paddle freely rotating. Upon stalling of the drive shaft due to its engagement with the bulk material, torque is transmitted to the motor, causing rotation of the motor and its bracket and bracket arm to a second switch-operating position against the action of the torsion spring. A plurality of switches within said housing have switch arms operatively engaged by the bracket arm when in its second position for selectively controlling the start and stop operations of conveyors, elevators or feeders and to provide an audible or visual warning signal.

19 Claims, 3 Drawing Figures

LEVEL CONTROL SENSOR SWITCH MECHANISM

BACKGROUND OF THE INVENTION

Heretofore, level control sensor switch mechanisms have been used which are mountable upon a bin containing bulk material of varying levels and wherein, a low speed electric motor within the sensor housing is adapted to continuously drive a paddle when out of contact with bulk material within the bin and which motor will stall when the level of bulk material within the bin reaches the paddle impeding its rotation.

Various types of signal mechanisms have been heretofore used which respond to the stalling of the motor due to the level of the bulk material. One characteristic of prior art devices is that there may be a false signaling of the material level in the bin due to product surges during filling or emptying of the bin.

Another problem with pre-existing devices is the lack of sensitivity of the control mechanism depending upon the density of the material stored within the bin and dispensed therefrom. Heretofore, it has been necessary to increase or decrease the size of the paddle areas, making the unit more or less responsive to bulk material levels.

Heretofore, with the level control sensor mechanism being used in conjunction with chemicals and other particulate materials, some of which may be corrosive, there has been damage to the moving parts of the sensor mechanism including the drive shaft and paddle, particularly to metal parts exposed within the bin.

Heretofore, furthermore, since the particulate materials may be of fine grain, there has been the problem of some of the material moving along the drive shaft and into the housing, damaging bearings and the motor.

Another problem which has existed with pre-existing devices is that they have been limited to the number of switch mechanisms which may be controlled by the sensor.

Heretofore, in the use of switch mechanisms, spring-loaded switch arms were employed for pushing the motor actuating arm away from the switch when the rotating paddle was free of the material.

SUMMARY OF THE INVENTION

It is an object of the present invention to overcome all of the aforesaid difficulties and primarily, to provide a time delay feature which is adjustable and wherein, there is prevented a false signaling of material level in the bin, preventing the unit from indicating product surges experienced during filling and emptying of a bin. This is accomplished by the use of an adjustable time delay stop mechanism for pre-setting the initial inactive rest position of the motor when the paddle is rotating freely of the bulk material. Accordingly, by increasing the distance that the motor must rotate for actuating a switch mechanism, there is provided a built-in adjustable time delay feature before activation of the switches and the mechanisms controlled thereby.

It is another object to provide a sensitivity adjustment by which the user may adjust the sensor mechanism to the density of the material within the bin without increasing or decreasing the paddle size to thus make the sensor more or less sensitive. This is accomplished by a sensitivity adjustment which regulates adjustably the torsion within the torsion spring, normally resisting rotation of the motor and the associated bracket to a switch-operating position.

It is another object to provide many of the parts of the present sensor of stainless steel including the mounting plate and all metal parts exposed within the bin and including the paddle, the paddle mounting and drive shaft.

It is another object to provide an improved seal mechanism for the drive shaft to prevent communication between the bin and the interior of the sensor housing for the protection of the interior parts thereof including the motor and switches and bearings.

It is another object to provide an improved level control sensor switch mechanism by which a plurality of separate micro-switches; i.e., as many as three or more micro-switches may be mounted in tandem within the housing for the purpose of activating three or four separate electrical circuits.

It is a further object to provide an improved sensor switch mechanism by which the motor is resiliently returned to its normal inactive position relative to the switches by an independent torsion spring and wherein, no reliance is placed upon the micro-switches for deactivation of the control.

These and other objects will be seen from the following specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF THE INVENTION

Figure 1:
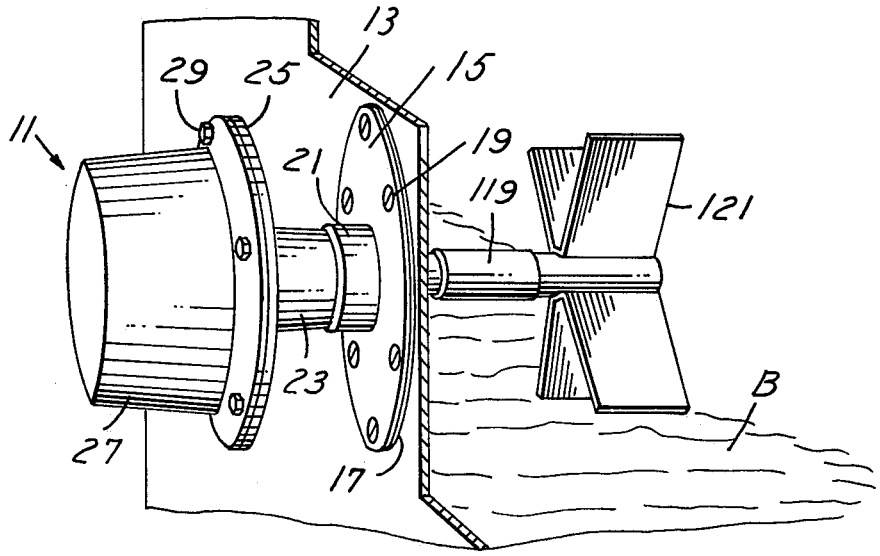
FIG. 1 is a perspective view of the present level control sensor switch mechanism as mounted upon the side wall of a bin, fragmentarily shown.
Figure 2:
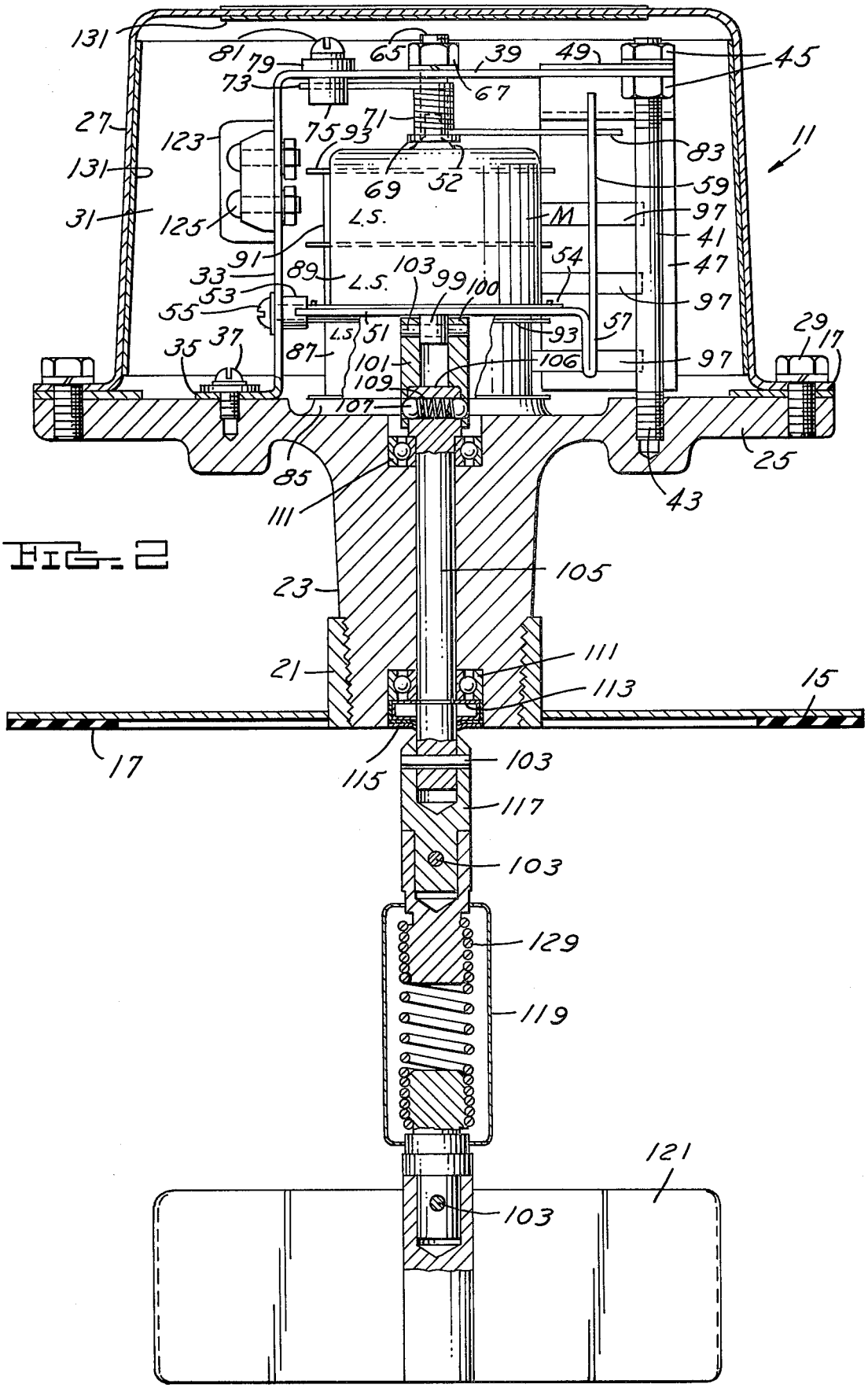
FIG. 2 is a vertical section of the level control switch mechanism shown in FIG. 1, on an increased scale.

Referring to the drawings, the present bulk material level control switch mechanism is generally indicated at 11, FIGS. 1 and 2, mounted upon a bin wall 13, which may be a side wall or a top wall and wherein, the bin stores bulk material B such as may be used in the aggregate, mining, chemical, plastics and other bulk-handling industries.

The present level conrol sensor switch mechanism normally includes a mounting plate 15 constructed of stainless steel and including an internally threaded pipe coupling or boss 21 suitably secured thereto as by welding for registry with and for securing to a side wall 13, or the top wall of a bin with a suitable vibration minimizing and sealing rubber gasket 17 interposed.

The mounting plate may be secured to the bin wall by welding or by a series of fasteners 19, such as shown for illustration, FIG. 1. Neck 23 exteriorly threaded at one end centrally depends from the cast housing base 25, which may be aluminum, preferably, said neck being snugly threaded down into coupling 21 for assembly with respect to mounting plate 15.

In some installations, the mounting plate may be omitted and the housing base 25 and associated neck otherwise directly secured to the bin wall by a coupling similar to the coupling 21 shown. This would be an equivalent construction by which the housing base and associated parts are affixed to a side or top wall of a bin such as the bin fragmentarily shown in FIG. 1.

The aluminum alloy cast housing top 27 overlies base 25 and has an outturned annular flange in registry with said base and secured thereto by a series of fasteners 29 with a suitable rubber or other resilient sealing gasket 17 interposed, and thereby defining chamber 31, FIG. 2.

Disposed within said chamber is an L-shaped adjustment bracket 33 whose outturned base flange 35 is secured to the base as by fasteners 37. Said adjustment bracket includes end plate 39 which is spaced from base 25 with its free end adjustably secured to the adjustment bracket post 41. Said post at one end is threaded down into said base as at 43. Its upper end is adjustably secured to end plate 39 by the pair of fasteners 45.

An elongated switch arm guard 47 extends at right angles to base 25 and includes a transverse top plate 49 which overlies end plate 39 and is secured thereto by the same fasteners 45 with respect to the post 41 or bolt which is sometimes hereafter referred to as "first means on the base adjustably supporting said end plate."

A low-torque, low-speed electric motor M is supported within said chamber adjacent the adjustment bracket and its end plate. Transverse motor bracket 51 underlies said motor and is suitably secured thereto by the transverse motor mount flanges 54 shown in FIG. 2.

The motor has a longitudinal central axis and laterally displaced therefrom output shaft 99 which is parallel to said axis. A stub 52 is aligned with said output shaft and projects from the opposite end of said motor and is journalled and received within an axial socket upon the end of torsion spring adapter 65 which depends from and is secured to end plate 39 as by the fastener 67.

Motor bracket 51 extends transversely of the motor axis and projects from opposite sides thereof and is adapted for limited rotary movement with the motor in a plane at right angles to said axis. A time delay adjustment stop nut 53 is mounted upon adjustment bracket 33 with respect to a lateral or transverse elongated slot therein and is secured in a pre-set adjusted position as by fastener 55.

As shown in FIG. 2, one end of the motor bracket is retainingly engaged by the adjustable stop 53, sometimes hereafter referred to as a time delay stop means.

Said motor bracket upon the opposite side of said motor projects laterally thereof, and at its end has a depending motor bracket extension 57 which terminates in a reverse-turned motor bracket extension arm 59 which is at right angles to said motor bracket.

Figure 3:
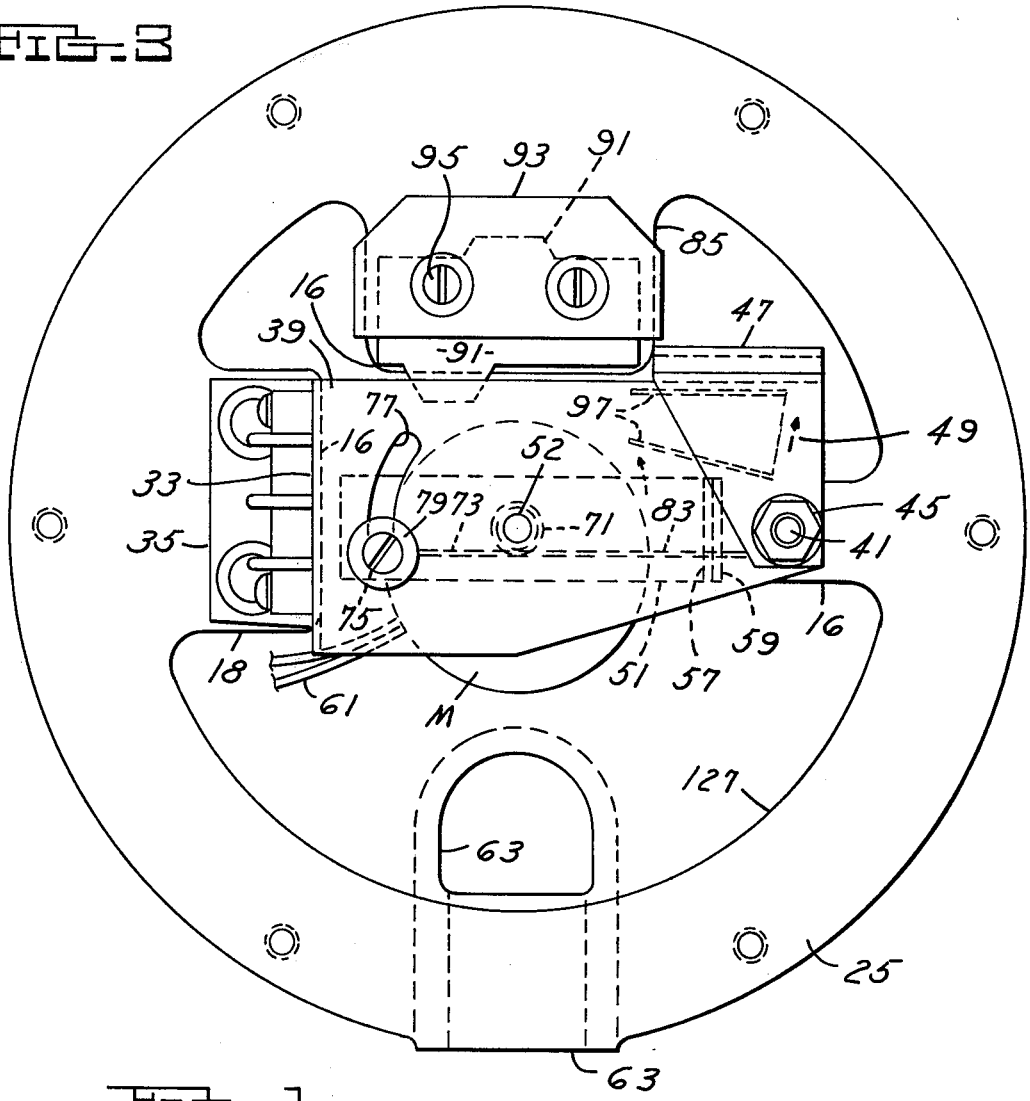
FIG. 3 is a plan view thereof with the housing cover removed.

The motor leads, fragmentarily shown at 61, FIG. 3, are normally connected to the terminals 125 upon motor terminal block 123 mounted upon adjustment bracket 33. Additional conductors are connected to terminals 125 and extend outwardly from the housing through the lead wire fitting 63 on base 25. Any other electrical leads are introduced into said housing chamber 31 through this same lead wire fitting adapted for connection to the respective micro-switches, hereafter described, such as micro-switches 87, 89 and 91.

The torsion spring adapter 65 adjacent its socketed end has a collar 69 to cooperatively receive and support torsion spring 71, FIG. 2. The spring includes a pair of oppositely directed spring ends such as 73 and 83. The spring end 73 is adjustably anchored by engagement with the sensitivity adjustment nut 75 which depends from end plate 39 of the adjustment bracket and is adjustably secured thereto by fastener 81 and the associated collar 79. Said sensitivity adjustment nut is sometimes hereafter referred to as second means for anchoring one end of the torsion spring upon said adjustment bracket.

The sensitivity adjustment nut 75 is mounted adjacent the arcuate slot 77, FIG. 3, formed through end plate 39 of the adjustment bracket and thus is adjustable along the length of the slot for regulating the torsion of said spring as transmitted through the other spring end 83. End 83 is in operative engagement with motor bracket extension arm 59, normally biasing said bracket and the attached motor to its first inactive or normal position.

By adjusting the nut 75 along the length of the arcuate slot 77, the sensitivity of the adjustment nut and the associated torsion spring are regulated, thereby adjusting unit to the density of the material in the bin.

Laterally displaced from the axis of the base 25 and the corresponding neck 23 there is provided a switch mount boss 85 as a part of said base which, otherwise, has a central aperture 127 therethrough as shown in FIG. 3. Right angularly related to the boss 85 is the radial inwardly directed boss 16 into which the upright adjustment bolt 41 is secured.

Oppositely arranged with respect to the boss 16 relative to the central opening 127 of the base is an additional boss 18 upon which is mounted and secured the support flange 35 for the adjustment bracket 33 secured thereto at 37, FIG. 2. A plurality of stacked micro-switches 87, 89 and 91 are mounted upon boss 85 of the housing base with a plurality of switch barrier insulators 93 interposed. The respective limit switches, FIG. 3, have a pair of aligned apertures therethrough to receive the elongated screw fasteners 95 which are threaded down into and secured within boss 85.

Each of the micro-switches includes a conventional laterally extending switch arm 97. The switch arms, being in parallel spaced relation, extend at right angles to motor bracket extension arm 59 in the path of its rotary movement into a second position. Each of the switch arms 97 is protectively enclosed by the elongated switch arm guard 47, whose top plate 49 overlies adjustment bracket end plate 39 and is suitably secured thereto as by the elongated post 41 and fasteners 45.

The end of motor output shaft 99 is transversely slotted, and projects into one end of the slip clutch 101 and is secured thereto by the transverse pin 103. Elongated drive shaft 105, preferably constructed of stainless steel has at one end a head 106 which is nested within a corresponding axial opening in the opposite end of the slip clutch 101.

A compression spring 109 is nested within a transverse aperture within said head and engages at its opposite ends the opposed steel balls 107 nested within corresponding hemispherical sockets within the slip clutch 101.

Accordingly, by means of the slip clutch the rotative power is transmitted from output shaft 99 to drive shaft 105 with the slip clutch arrangement preventing damage to the motor gearing should there be relative rotation of the drive shaft with respect to the output shaft.

A pair of longitudinally spaced ball bearings 111 which are sealed and permanently lubricated are of a precison construction, are nested within corresponding spaced apertures within neck 23, FIG. 2, and are in cooperative bearing registry with the rotative drive shaft 105. The head 106 at its lower end is supportably mounted upon the upper ball bearing 111. Said head, in turn, supports the sleeve-like slip clutch 101 which axially and supportably engages the undersurface of the motor with a suitable washer 100 interposed.

In the illustrative embodiment, the motor is 4-Watt, 115 to 120 volt, or 230 to 240 volt AC, as determined. It is rated 50/60 HZ, 1 RPM synchronous. Other voltages may be employed, depending upon the load encountered by the material and the consistency of the particulate bulk material within the bin and with respect to which paddle 121 is rotatable.

The above micro-switches 87, 89 and 91 are rated 20 AMP at 125, 250 or 480 VAC. One horsepower, 125 VAC; 2 horsepower, 250 volt AC; ½ AMP, 125 volt DC; ¼ AMP, 250 VAC. Said micro-switches are each single pull double throw in construction and operation.

Snap ring 113 supports the lower ball bearing assembly 111 within neck 23.

Flexible shaft seal assembly 115 is axially nested within said neck within the same recess containing the bearing 111 and is adapted to yieldably and wipingly engage the surface of drive shaft 105 throughout 360 degrees.

The function of the seal is to block out from the interior of said housing conditions within the bin, including particles or moisture for the protection of the parts of the present sensor mechanism within chamber 31 of the housing assembly 25–27, including the bearings.

The lower end of the drive shaft 105 extends into shaft adapter 117 and is secured thereto by the transverse pin 103. Said shaft adapter projects into flexible shaft assembly, generally indicated at 119 and is secured thereto by the pin 103.

The flexible shaft assembly also includes a depending shaft adapter which is pinned as at 103 to a paddle assembly 121, preferably constructed of stainless steel.

The flexible shaft assembly includes an elongated coil spring 129 to thus establish a flexible connection between drive shaft 105, shaft adapter 117 and paddle 121, also shown in FIG. 1.

Referring to FIG. 2, elongated strips 131 of cover barrier insulation are applied to interior surface portions of the housing cover 27 as well as to the interior sides thereof.

In operation, the paddle sensor mechanism is connected to the low-torque 4-Watt synchronous motor M. The sensor rotates continuously inside the bin at a slow 1 RPM, for example. When the paddle meets the resistance of accumulated material, it transfers its torque to the motor which is adapted to rotate in a plane at right angles to its axis throughout a short distance against the action of the torsion spring 71 until bracket arm 59 comes into a second position in operative engagement with the micro-switch arms 97.

These switches can be used to control the start-stop operations of conveyors, elevators or feeders, and to provide audible and visual warning signals to designate the level of the bulk material within the bin. Thus, there is provided a perpetual sentinel watching over the storage bins and to eliminate the problem of material overflow, empty bins at normally high or low levels, plugged chutes, jambed conveyors and damaged equipment.

The character of the shaft seal 115 may be modified, depending upon pressure conditions within the bin up to 30 PSI and with particle size of the bulk material as low as ½ micron.

In the level control sensor when a stainless steel mounting plate is used for either mounting on the top of a bin or on the side of a bin a unique arrangement of the mounting plate and seal is provided to prevent exposure of the casting inside the bin. It is often necessary because of contamination considerations to provide equipment used inside a bin completely of stainless steel. Heretofore, all level controls of the rotating paddle type when supplied with stainless steel mounting plates have always still exposed a small annular ring of the casting material inside the bin. This is shown in FIG. 2 as the material exposed between the coupling 21 and the seal 115. The material exposed is the casting material used in part 23.

In order to solve the problem of contamination and furnish a level control with all metal parts exposed within the bin of stainless steel, a unique approach was taken that removes the seal from the casting 23 and places it in the mounting plate itself. The mounting plate seal and special end piece are all constructed of stainless steel with the seal pressed into the special end piece. The level control sensor is constructed without a seal and with part 23 cut down to provide the space for the special end piece on the mounting plate. The result is that all metal parts exposed in the bin are of stainless steel.

Having described my invention, reference should now be had to the following claims.

I claim:

1. In a level control sensor switch mechanism mountable upon a bin containing bulk material of varying levels, having a mounting plate secured to said bin, a housing base having an apertured neck secured to said mounting plate and a hollow housing top mounted on and secured to said base defining a chamber, a low torque low speed electric motor having a longitudinal central axis, within said chamber having an output shaft parallel to said axis, a drive shaft aligned with and coupled to said output shaft journalled and supported through said neck extending through a wall of said bin, and a paddle on the end of said drive shaft continuously rotatable within said bin when free of said bulk material, and non-rotatable in said bulk material at a predetermined level thereof, stalling said motor;

the improvement comprising:

an adjustment bracket mounted upon said base, having an end plate spaced from said base;

first means on said base adjustably supporting said end plate;

a torsion spring adapter secured to said end plate;

stub means on said motor aligned with said output shaft projected into and journalled within said adapter for limited rotary movement;

a bracket secured to said motor and extending transversely of said axis, projecting from opposite sides of said motor and adapted for limited rotary movement with said motor in a plane at right angles to said axis;

time delay stop means adjustably mounted upon said adjustment bracket retainingly engaging one end of said motor bracket;

an extension arm on said bracket at right angles thereto;

a torsion spring on said adapter;

second means anchoring one end of said spring upon said adjustment bracket;

the other end of said spring biasing said bracket arm and motor into a normal first position with said bracket engaging said stop means, said output shaft and paddle freely rotating;

and upon stalling of said drive shaft, transferring its torque to said motor for rotating said motor and bracket and bracket arm to a second switch operating position against the action of said torsion spring;

and a switch means within sai chamber mounted on said housing base having a switch arm operatively engaged by said bracket arm when in said second position, adapted for controlling selectively the start and stop operations of conveyors, elevators, or feeders, and to provide audible or visual warning signals;

said motor bracket automatically returning to its first position when said paddle becomes disengaged from said bulk material and its motor is unrestricted.

2. In the level control sensor of claim 1, the mounting of said adjustment bracket including an outturned flange secured to said housing base.

3. In the level control sensor of claim 1, said first means including an elongated bolt at one end threaded into said housing base, and at its other end adjustably engaging and secured to said bracket end plate.

4. In the level control sensor of claim 1, said torsion spring adapter depending from said end plate and having an axial socket;

said stub means nested in said socket.

5. In the level control sensor of claim 1, said time delay stop means including a nut anchored upon said adjustment bracket in the path of rotary movement of said motor bracket and setting its first position, thus determining the amount of movement of said motor bracket to its second position and the time it takes to move to said second position after the motor is stalled, thus providing an adjustable time delay to prevent false signaling of material level in the bin.

6. In the level control sensor of claim 5, the adjustable mounting of said time delay stop means including a transverse elongated slot in said adjustment bracket coplanar with said plane of movement;

and fastening mans for securing said nut to said adjustment bracket along the length of said slot for advancing and retracting the location of said first position of said motor bracket.

7. In the level control sensor of claim 1, said second means including a nut anchored upon the end plate of said adjustment bracket, one end of said torsion spring lying in a second plane at right angles to the axis of said torsion spring;

said nut lying in said second plane.

8. In the level control sensor of claim 1, said second means including a nut adjustably anchored upon and depending from said end plate;

the adjustable anchoring of said nut including an arcuate slot in said end plate receiving said nut;

and a fastener engaging said nut and end plate for adjustably securing said nut along the length of said arcuate slot to selectively increase and decrease the torsion in said torsion spring and, accordingly, regulate the sensitivity of adjustment of said motor bracket rotating to its second position, thereby permitting adjustment of the sensor to the density of the material in the bin.

9. In the level control sensor of claim 1, said mounting plate, drive shaft and paddle being of stainless steel.

10. In the level control sensor of claim 1, one end of said neck having an undercut annular recess surrounding said drive shaft;

and a flexible seal nested within said recess and in continuous wiping engagement with said drive shaft through 360 degrees, sealing off said compartment from said bin.

11. In the level control sensor of claim 1, said switch means including a micro-switch within said chamber mounted upon said housing base and laterally displaced from said drive shaft, said switch arm extending laterally of said switch in the path of rotary movement of said motor bracket arm.

12. In the level control sensor of claim 1, said switch means including a pair of independent micro-switches mounted within said chamber upon said housing base in insulated relation, said micro-switches having parallel switch arms lying in the path of rotary movement of said motor bracket arm, whereby said micro-switches may be simultaneously activated.

13. In the level control sensor of claim 1, said switch means including a plurality of independent micro-switches mounted within said chamber upon said housing base in insulated relation, said switches including parallel switch arms lying in the path of rotary movement of said motor bracket whereby, said micro-switches may be simultaneously activated.

14. In the level control sensor of claim 13, the mounting of said micro-switches including a pair of spaced fasteners extending through aligned openings in said micro-switches and threaded into said housing base.

15. In the level control sensor of claim 3, an elongated switch arm guard plate within said chamber having a right-angular end plate overlying said adjustment bracket end plate and secured to said elongated bolt, said guard plate extending at right angles to said housing base and spaced outwardly of said switch arm.

16. In the level control sensor of claim 1, the coupling of said drive shaft to said motor output shaft including a slip clutch aligned with and interconnecting end portions of said shafts.

17. In the level control sensor of claim 16, spaced bearings supported within said housing neck;

said drive shaft having a shoulder supported upon one of said bearings;

said slip clutch being mounted upon said drive shaft and supportably engaging said motor within said chamber.

18. In the level control sensor of claim 16, said slip clutch at one end receiving and secured to said output shaft;

said drive shaft having a head loosely projected into the other end of said clutch;

there being a transverse slot through said head;

and a pair of spring-biased balls within said head, there being a pair of opposed sockets in said clutch yieldably receiving said balls.

19. In a level control sensor switch mechanism mountable upon a bin containing bulk material of varying levels, having a housing base secured to said bin and a hollow housing top mounted on and secured to said base defining a chamber, a low-torque, low-speed electric motor having a longitudinal central axis within said chamber having an output shaft parallel to said axis, a drive shaft aligned with and coupled to said output shaft journalled and supported through said base extending through a wall of said bin, and a paddle on the end of said drive shaft continuously rotatable within said bin when free of said bulk material, and non-rotatable in said bulk material at a predetermined level thereof, stalling said motor, the improvement comprising:

an adjustment bracket mounted upon said base, having an end plate spaced from said base, a bolt on said base adjustably supporting said end plate;

a torsion spring adapter secured to said end plate;

a stub on said motor aligned with said output shaft projected into and journalled within said adapter for limited rotary movements;

a bracket secured to said motor and extending transversely of said axis, projecting from opposite sides of said motor and adapted for limited rotary movement with said motor in a plane at right angles to said axis;

a time delay stop nut adjustably mounted upon said adjustment bracket retainingly engaging one end of said motor bracket;

an extension arm on said bracket at right angles thereto;

a torsion spring mounted on said adapter;

a nut adjustably mounted upon said adjustment bracket anchoring one end of said spring;

the other end of said spring biasing said bracket arm and motor into a normal first position with said bracket-engaging said stop nut, said drive shaft and paddle freely rotating; and upon stalling of said shaft, transferring its torque to said motor for rotating said motor, bracket and bracket arm to a second switch-operating position against the action of said torsion spring;

and a plurality of stacked micro-switches mounted on said housing base within said chamber, each having a switch arm operatively engaged by said bracket arm when in said second position, adapted for controlling selectively the start and stop operations of conveyors, elevators, or feeders, and to provide and audible or visual warning signal.

* * * * *